United States Patent [19]

Murayama et al.

[11] Patent Number: 4,772,771

[45] Date of Patent: Sep. 20, 1988

[54] METHOD FOR THE PRODUCTION OF HIGH STRENGTH ELECTRIC SEAM WELDED OIL-WELL PIPE

[75] Inventors: Hiroshi Murayama; Youji Yamamoto; Motofumi Koyuba, all of Tokai, Japan

[73] Assignee: Nippon Steel Corporation, Tokyo, Japan

[21] Appl. No.: 865,476

[22] Filed: May 21, 1986

[30] Foreign Application Priority Data

May 28, 1985 [JP] Japan ..... 60-113152

[51] Int. Cl.[4] ..... B23K 11/08

[52] U.S. Cl. ..... 219/67; 219/137 WM; 219/59.1

[58] Field of Search ..... 219/137 R, 137 WM, 67, 219/69.1; 148/127, 12.4, 909

[56] References Cited

U.S. PATENT DOCUMENTS 4,523,072 6/1985 Nakate et al. ..... 219/67

FOREIGN PATENT DOCUMENTS 23021 2/1979 Japan ..... 219/137 WM
91934 7/1980 Japan ..... 148/12.4
33429 4/1981 Japan ..... 148/12.4

*Primary Examiner*—E. A. Goldberg
*Assistant Examiner*—C. M. Sigda
*Attorney, Agent, or Firm*—Wenderoth, Lind & Ponack

[57] ABSTRACT

A method for the production of an electric seam welded steel pipe for oil-well use which has good resistance to collapse pressure and souring, by providing a steel containing 0.08–0.26% C by weight, 0.8–1.9% Mn by weight, 0.5% or less Si by weight, the remainder being Fe and unavoidable impurities, subjecting the steel to hot rolling, and hardening, and coiling the treated steel at a temperature not exceeding 250° C., after which the steel is then formed into tubular form and welded by electric resistance welding to produce an electric seam welded pipe, and the weld heat affected zones of the pipe are subjected to heating to a temperature of 900° C. or more to effect hardening, and then the whole pipe is tempered.

2 Claims, 1 Drawing Sheet

METHOD FOR THE PRODUCTION OF HIGH STRENGTH ELECTRIC SEAM WELDED OIL-WELL PIPE

BACKGROUND OF THE INVENTION

1. Field of the Invention

The present invention relates to a method for the production of a high strength electric seam welded oil-well pipe.

2. Description of the Prior Art

With the increasing depths being drilled for oil and gas, there is increasing demand for high strength oil-well pipe. This demand is barely satisfied by the use of high strength pipe obtained in the form of seamless pipe which has been subjected to quenching and tempering.

However, more recently, high strength oil-well pipe has been manufactured by a method which comprises subjecting electric seam welded pipe to quenching and tempering. Such electric seam welded pipe is more inexpensive than seamless pipe, but has certain demerits, as follows:

(1) The finer grain produced by controlled rolling and controlled cooling, an advantage of electric seam welded pipe, cannot be fully utilized.

(2) Such strengthening precipitation type elements as Nb, V or Ti, another advantage of electric seam welded pipe, cannot be utilized.

(3) Because the dimensional precision, another advantage of electric seam welded pipe, is adversely affected by quenching, straightening and leveling is required.

Thus, a disadvantage of the prior art is that the production of the high strength oil-well pipe by subjecting electric seam welded pipe to quenching and tempering cancels out all the inherent advantages of electric seam welded pipe.

SUMMARY OF THE INVENTION

It is a prime object of the present invention to provide a method for the production of electric seam welded steel pipe for oil-wells which has excellent resistance to collapse pressure and souring.

It is another object of the invention to provide a method for the production of electric seam welded pipe for oil-wells which has good roundness and straightness.

BRIEF DESCRIPTION OF THE DRAWING

Other and further objects of the present invention will become apparent to those skilled in the art from the following detailed description and the drawing.

DETAILED DESCRIPTION OF THE INVENTION

Figure 1:
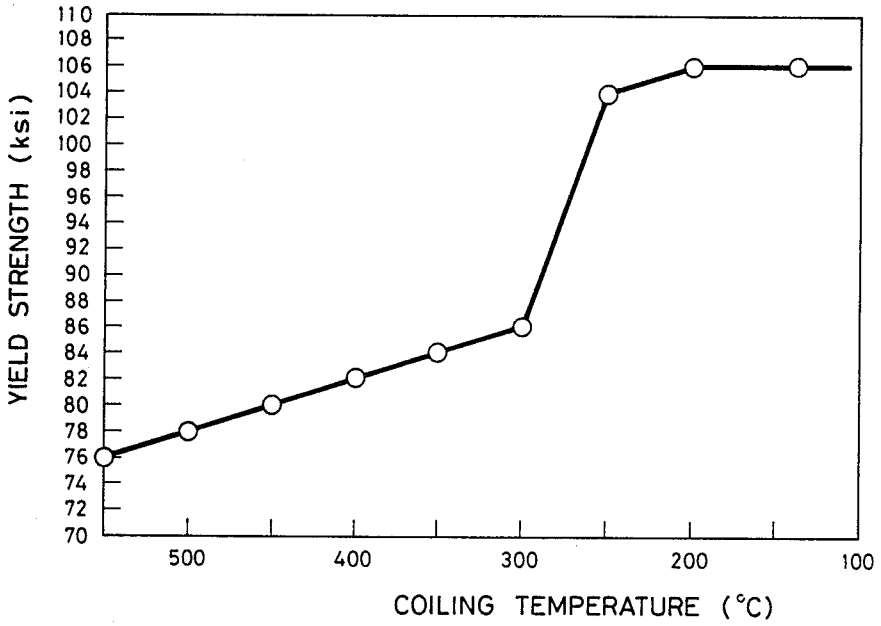
FIG. 1 is a graph showing the relationship between the coiling temperature and the yield strength.

The fundamental composition of the steel of the present invention comprises 0.08–0.26% C by weight ("by weight" will hereinafter be omitted), 0.8–1.9% Mn, 0.5% or less Si, and the remainder Fe and unavoidable impurities, through one or more elements selected from the group consisting of 0.05% or less Nb, 0.05% or less V, 0.03% or less Ti, and 0.0020% or less B can be added to the steel.

The constituent requirements of the present invention will now be described.

C is important to obtain the necessary tensile strength, and as such should be present in an amount of at least 0.08%. However, there should not be more than 0.26% C, because as the amount of C increases, the difference in the structural hardness between the welded portions and the parent metal increases even though only the welded zone is quenched and the entire electric seam welded pipe is tempered after the welding is completed.

The addition of 0.8% or more Mn is also essential, to ensure the required tensile strength and it is also effective in making the ferrite grain finer, but when Mn exceeds 1.9%, ductility and toughness are deteriorated. Hence the specified range of Mn is 0.8–1.9%.

Si is also required to ensure the necessary tensile strength, but if there is more than 0.5% Si, the frequency of welding oxide production becomes high, and hence the specified range of Si is 0.10–0.5%.

A precipitation element such as, Nb, V, or Ti is added to the steel in order to ensure the required strength. These are also effective elements for improving the yield strength, as a result of the higher precipitation strength in ferrite grain and the grain refining of ferrite grain. Accordingly, one or more elements are added within the limit value of the solid solution. The limit value of the elements is 0.05% Nb, 0.05% V, and 0.03% Ti. In addition, B is an effective element to improve the hardenability of steel, but when the amount of B exceeds 0.0020%, it produces an increase in harmful carbonitride compounds. Hence, the amount of B should not exceed the 0.0020%.

Further, the steel of the present invention is deoxidized by the use of Al, and the usual amount of Al will remain therein.

Billets may be produced by ingot making, slabbing, continuous casting or the like, but with respect to producing a fine grain, the continuous casting is the most advantageous.

Next, the cooling conditions following the hot rolling will be described. For the purpose of quenching the steel, the cooling rate should be as high as possible. In general, when the pipe is quenched, cooling proceeds only from the outer surface of the pipe. Hot coil coming from the hot rolling mill can be subjected to cooling on both sides thereof.

Accordingly, the present invention is characterized in that hardening is easier than with pipe.

In accordance with the present invention, quenching is done from the austenitic grain non-recrystallization phase to refine the ferrite grain, and hence it is carried out at about 850° C.

Apart from the hardening of the whole pipe, the hardening of this invention is characterized in that a very fine homogeneous structure can be obtained, the reheating of the electric seam welded pipe is no longer required, and, further, the fine grain resulting from the hot rolling process can be directly utilized.

The controlled rolling is carried out in the hot rolling process to produce a very fine grain, and hence it is more beneficial.

As shown in FIG. 1, the hardened structure can be stably secured by coiling the steel strip at a temperature that does not exceed 250° C. If the steel strip is coiled at a temperature above 250° C., the hardened structure is softened by a self-tempering effect, and the specified strength will not be maintained.

The strain from the forming of the strip into electric seam welded pipe facilitates the subsequent tempering. In other words, the diffusion in the course of the tempering is facilitated by the high dislocation density of the forming strain of the electric seam welded pipe, and hence it is one of the merits of the present invention that the tempering can be effected within a very short period of time.

Next, the electric seam welded zone is described. As mentioned above, as the steel coil has been subjected to quenching just the welded zone loses its hardened structure as a result of the heat of the electric seam welding. Thus, in accordance with the present invention, only the welded zone is heated to the $Ar_3$ transformation temperature or above by electric induction heating so as to completely austenitize the steel, and it is then subjected to hardening in the above-mentioned state. Namely, after heating the parts of the pipe to a temperature of 900° C. or more, where it can be hardened, the whole of the pipe is transformed to a hardened structure by quenching.

Next, the whole pipe is subjected to tempering, and the diffusion is accelerated by the forming strain even after the completion of the hardening. As a whole, the tempering temperature is lower and the time is shorter than in the case of the conventional method. This is a saving of energy, one of the features of the present invention.

In accordance with the method for the production of the electric seam welded pipe of the present invention, the manufactured pipe is subjected to tempering after the forming step, with the merit of the hot rolled coil being unaffected except for the portions affected by the welding heat thereof, so that the steel has a very fine grain structure. Also, it is possible to use fully the precipitation strength provided by the addition of Nb and the like, and with no deterioration in the pipe's dimensional precision from the hardening.

Namely, with the conventional quenching and tempering process of the whole pipe, the fine grain structure obtained from the hot rolling is transformed to a coarse grain structure by the reheating to the $A_3$ transformation temperature or above. Moreover, the fine precipitation of Nb and the like loses its merit of increasing the precipitation strength because of the grain enlargement by aggregation resulting from the reheating step employed.

Furthermore, the hardening conducted on the whole pipe causes loss of roundness and straightness of the pipe, so that straightening and leveling is required.

Since the roundness and straightness of the pipe is so deteriorated by the conventional tempering of the pipe that corrective steps are required to achieve the required precision after the tempering, there takes place the Bauschinger effect and other such undesirable effects. However, since in this invention the forming step is carried out to a specified size after the hardening, i.e. to a specified final product diameter, such problems do not rise. In addition, the tempering temperature is lower and the time is shorter than in the case of the conventional method, because of the accelerated diffusion resulting from the forming strain.

As compared with the conventional pipe manufactured by subjecting the whole pipe to hardening and tempering, the pipe produced by the method of the present invention has a fine grain structure that gives it good resistance to collapse and souring, and can be produced at a low cost and with a good yield. Accordingly, the present invention will be beneficial to the steel industry.

EXAMPLE

A test was conducted on sample pipes of 7"×0.362" size, which included conventional pipe and the pipe of this invention. The conditions and results of the test are shown in Table 1. The pipe produced by the method of this invention shows excellent values with respect to resistance to collapse pressure and souring.

TABLE 1

| Sample No. | C (wt %) | Mn | Si | Nb | V | Ti | B | Coiling temp. (°C.) | Coil hardening (°C.) | Seam hardening (°C.) |
|---|---|---|---|---|---|---|---|---|---|---|
| 01 | 0.10 | 1.32 | 0.15 | 0.041 | — | 0.015 | 0.0015 | 250 | 820 | 900 |
| 02 | 0.24 | 1.85 | 0.19 | — | — | — | — | 200 | 810 | 920 |
| 03 | 0.20 | 1.15 | 0.17 | 0.039 | 0.045 | 0.011 | — | 200 | 790 | 900 |
| 04 | 0.18 | 1.60 | 0.20 | — | — | 0.018 | 0.0020 | 250 | 800 | 900 |
| 05 | 0.10 | 1.32 | 0.15 | 0.041 | — | 0.015 | 0.0015 | 200 | 820 | — |
| 06 | 0.24 | 1.85 | 0.19 | — | — | — | — | 250 | 810 | — |
| 07 | 0.20 | 1.15 | 0.17 | 0.039 | 0.045 | 0.011 | — | 250 | 790 | — |
| 08 | 0.18 | 1.60 | 0.20 | — | — | 0.018 | 0.0020 | 250 | 800 | — |
| 09 | 0.10 | 1.32 | 0.15 | 0.041 | — | 0.015 | 0.0015 | 650 | — | — |
| 10 | 0.24 | 1.85 | 0.19 | — | — | — | — | 650 | — | — |
| 11 | 0.20 | 1.15 | 0.17 | 0.039 | 0.045 | 0.011 | — | 650 | — | — |
| 12 | 0.18 | 1.60 | 0.20 | — | — | 0.018 | 0.0020 | 650 | — | — |
| 13 | 0.23 | 1.25 | 0.15 | — | — | 0.020 | 0.0010 | 700 | — | — |
| 14 | 0.23 | 1.25 | 0.15 | — | — | 0.020 | 0.0010 | 700 | — | — |
| 15 | 0.25 | 1.40 | 0.18 | — | — | 0.025 | 0.0018 | 720 | — | — |
| 16 | 0.25 | 1.40 | 0.18 | — | — | 0.025 | 0.0018 | 720 | — | — |

| Sample No. | Pipe hardening (°C.) | Pipe tempering (°C.) | Yield strength (Kgf/mm²) | Collapse pressure (Kgf/cm²) | Souring resistance (base metal) (10 ksi) | Souring resistance (ERW) (10 ksi) | Remarks |
|---|---|---|---|---|---|---|---|
| | | | | | (bis) | | |
| 01 | — | 520 | 60 | 570 | 18 | 18 | This invention |
| 02 | — | 520 | 67 | 580 | 19 | 17 | This invention |
| 03 | — | 550 | 65 | 580 | 19 | 19 | This invention |
| 04 | — | 530 | 63 | 560 | 19 | 18 | This invention |
| 05 | — | 520 | 61 | 570 | 19 | X 8 | Compared pipe |
| 06 | — | 520 | 67 | 570 | 19 | X 4 | Compared pipe |
| 07 | — | 550 | 64 | 600 | 20 | X 5 | Compared pipe |
| 08 | — | 530 | 64 | 570 | 19 | X 7 | Compared pipe |
| 09 | — | 520 | X 51 | X 490 | X 9 | X 7 | Compared pipe |
| 10 | — | 520 | X 55 | X 470 | X 10 | X 5 | Compared pipe |
| 11 | — | 550 | X 52 | X 490 | X 8 | X 6 | Compared pipe |
| 12 | — | 530 | X 53 | X 480 | X 9 | X 7 | Compared pipe |

TABLE 1-continued

| | | | | | | | |
|---|---|---|---|---|---|---|---|
| 13 | 900 | 600 | 60 | 520 | 12 | X 11 | Compared pipe |
| 14 | 900 | 620 | 57 | 500 | 12 | 12 | Compared pipe |
| 15 | 900 | 600 | 62 | 530 | 12 | 12 | Compared pipe |
| 16 | 900 | 620 | 60 | 520 | 13 | 14 | Compared pipe |

Pipe size: 7" × 0.362"
Souring Resistance is measured by the Shell-type Bent Beam Test
: good
: a little better
X: bad

What is claimed is:

1. A method for the production of a high strength electric seam welded pipe for oil-well use, which comprises:

providing a steel containing, by weight, 0.08–0.26% C, 0.8–1.9% Mn, 0.10–0.5% Si, 0–0.05% Nb, 0–0.05% V, 0–0.03% Ti, 0–0.0020% B, and the remainder being Fe and unavoidable impurities, subjecting said steel to hot rolling to produce a hot rolled steel sheet, subjecting said hot rolled steel sheet to quenching from an austenitic grain non-recrystallization phase to produce a hardened steel sheet, coiling said hardened steel sheet at a temperature not exceeding 250° C., forming the coiled steel sheet into a tubular form to a specified final product diameter to give a forming strain resulting from said forming, welding said tubular form by an electric welding process to produce a steel pipe, reheating only the welded zone of said steel pipe having the forming strain to a temperature above 900° C. by induction heating, quenching the reheated welded zone, and subjecting the whole steel pipe to tempering.

2. A method as claimed in claim 1 in which said steel contains one or more of said Nb, V, Ti and B.

* * * * *